United States Patent [19]

Steeb

[11] 4,434,845

[45] Mar. 6, 1984

[54] STACKED-PLATE HEAT EXCHANGER

[76] Inventor: Dieter C. Steeb, Im Schönenbühl, CH-9050 Steinegg-Appenzell, Switzerland

[21] Appl. No.: 347,068

[22] Filed: Feb. 8, 1982

[30] Foreign Application Priority Data

Feb. 25, 1981 [DE] Fed. Rep. of Germany ..... 3107010

[51] Int. Cl.[3] ..... F28D 9/02; F28F 3/06

[52] U.S. Cl. ..... 165/153; 165/166; 165/183; 165/DIG. 9

[58] Field of Search ..... 165/167, 166, 165, 170, 165/183, 185, 149, 152, 153, DIG. 9

[56] References Cited

U.S. PATENT DOCUMENTS

| | | | |
|---|---|---|---|
| 902,812 | 11/1908 | Goetz et al. | 165/170 |
| 1,404,721 | 1/1922 | Stein | 165/165 |
| 3,205,563 | 9/1965 | Pauls et al. | 29/157.3 V |
| 3,650,005 | 3/1972 | Kamiya et al. | 165/170 X |
| 3,932,090 | 1/1976 | Brumlik | 425/381 |
| 4,083,400 | 4/1978 | Dziedzic et al. | 165/165 |
| 4,150,719 | 4/1979 | Thielen et al. | 165/166 X |

FOREIGN PATENT DOCUMENTS

| | | | |
|---|---|---|---|
| 2332047 | 1/1975 | Fed. Rep. of Germany | 165/166 |
| 2259006 | 7/1976 | Fed. Rep. of Germany . | |
| 7835175 | 2/1979 | Fed. Rep. of Germany . | |
| 3011011 | 9/1980 | Fed. Rep. of Germany | 165/166 |
| 2093583 | 9/1982 | United Kingdom | 165/166 |

*Primary Examiner*—Sheldon J. Richter

*Attorney, Agent, or Firm*—Hopgood, Calimafde, Kalil, Blaustein & Judlowe

[57] ABSTRACT

A heat exchanger comprises a stack of spaced plates such that elongate plane-parallel fluid-conduit systems are established between adjacent pairs of plates, the plane-parallel conduit systems being in two sets, with the conduit system of one set being interposed between two conduit systems of the other set. Between adjacent plates, a conduit system is closed along its two laterally opposite edges, by rail-like spacers between the involved adjacent plates. The conduit system of at least one set comprises corrugated structures taking the form of extruded sections and having ridges which are connected to the lateral-edge closures of the involved conduit system.

7 Claims, 2 Drawing Figures

STACKED-PLATE HEAT EXCHANGER

BACKGROUND OF THE INVENTION

The present invention relates to a heat exchanger having sheet-metal plates in spaced pairs, each pair having rail-like spacers positioned between laterally outer parallel longitudinal edges of the plates to keep them at a fixed distance from each other and for defining in each case a flat inner passage between the plates, the passage functioning as a conduit for a longitudinal flow of heat-exchange fluid, there being corrugated metal structures within said passage for increasing the heat-exchange surface area of the plates.

Prior-art heat exchangers of the character indicated are capable of being very simply produced, by sandwiched assembly of solder-coated sheet-metal plates with the rail-like spacers and with the corrugated metal structures, the sandwiched unit then being placed in a solder bath or in a soldering oven for bonded connection of the parts, that is to say, not only producing solder joints between the sheet metal plates and the outer-edge spacer rails (thereby determining, between each pair of plates, a fluid passage as a pipe of narrow cross-section), but also producing soldered connections at the points where the sheet metal plates are contacted by the corrugated structures within the passage. In prior-art heat exchangers, such corrugated structures have been produced in the form of thin corrugated metal strips or sheets somewhat like corrugated iron, there then being solder-fixed joints at outer limits of the folds in the corrugated strips or corrugated sheets.

Heat exchangers thus far produced along the indicated lines generally provide a first set of flat passages for the flow of a first fluid and a second set of flat passages for the flow of a second fluid. Generally, the flat fluid passages of one set are spaced by the flat fluid passages of the other set. In application as an air-oil heat exchanger for cooling purposes, one of the fluids is oil, under an elevated pressure, and the other of the fluids is air for cooling the oil. In application as a heat exchanger for an air compressor, both fluids are air. In such applications, very high pressure differences are likely between the cooling air, normally at atmospheric pressure, and the pressurized oil or air to be cooled. More specifically, in the case of an air/air heat exchanger for cooling in connection with a high-pressure compressor, or in the case of an air/oil heat exchanger for cooling a hydraulic system, the involved high pressure differences may not be safely contained in prior-art heat exchangers of the character indicated, so that in use, such heat exchangers may be unsafe.

BRIEF STATEMENT OF THE INVENTION

It is an object of the present invention to provide a heat exchanger of the character indicated with high inherent operational safety, particularly from the aspect of presenting no danger of the flat fluid passages being burst by high pressures.

The invention achieves this object and other features in a heat exchanger of the character indicated by providing the corrugated metal structures in the form of extruded sections. By using such extruded corrugated structure within the fluid passages, these passages are very much stronger, inasmuch as the extruded sections function to prevent the sheet-metal plates from being forced apart by pressure within the fluid passages. The prior conventional corrugated structures (in the form of undulating metal strips soldered to the metal plates at outer ends of the undulating folds) are relatively ineffective to prevent the metal plates being forced away from each other, because the curved folds of the metal strip may readily be straightened between locations of their metal-plate connection, thus enabling outward deformation of the involved plates away from each other, and in the case of higher pressures between the metal plates the corrugated structure can be broken. On the other hand, with an extruded section of the present invention integrated in the fluid passages, the heat exchanger becomes a stiff one-piece structure united with adjacent sheet-metal plates, so that the heat-exchanger structure as a whole is very much stronger.

In a preferred embodiment of the invention, a single-piece extruded section is characterized by a number of laterally spaced parallel straight ridges, joined together and extending in the longitudinal or flow direction of the fluid passages, and each such ridge has a support face resting squarely against the sheet metal plate to which it is adjacent. The presence of these ridges has the functional result of providing strong support surfaces at metal-plate abutment and bonding, the structure generally being thus made very much stiffer. The two sheet-metal plates of each narrow cross-section fluid passage are thus directly interconnected by each ridge so that, even in the case of very high fluid-passage pressures, there is no danger of the walls of the fluid passages being forced away from each other.

In a particularly preferred embodiment of the invention, the extruded section may have ridges at its two outer longitudinal edges, taking the form of integrally formed outer rail-like spacers.

DETAILED DESCRIPTION

Figure 1:
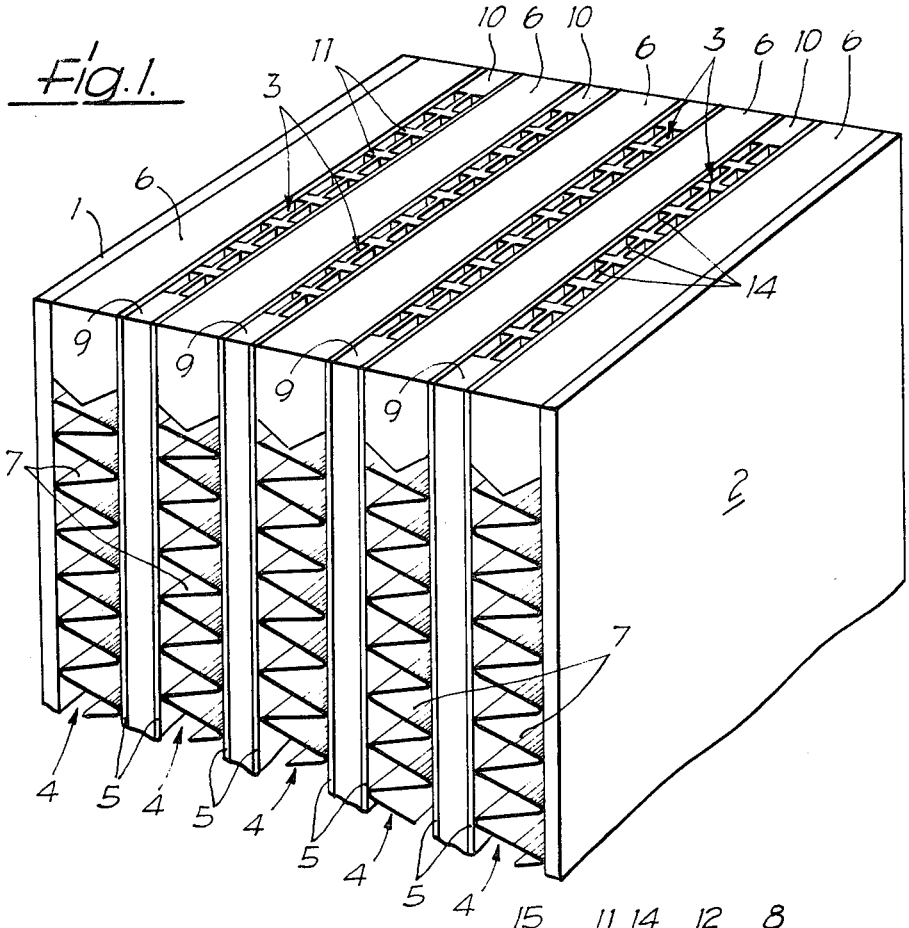
Figure 2:
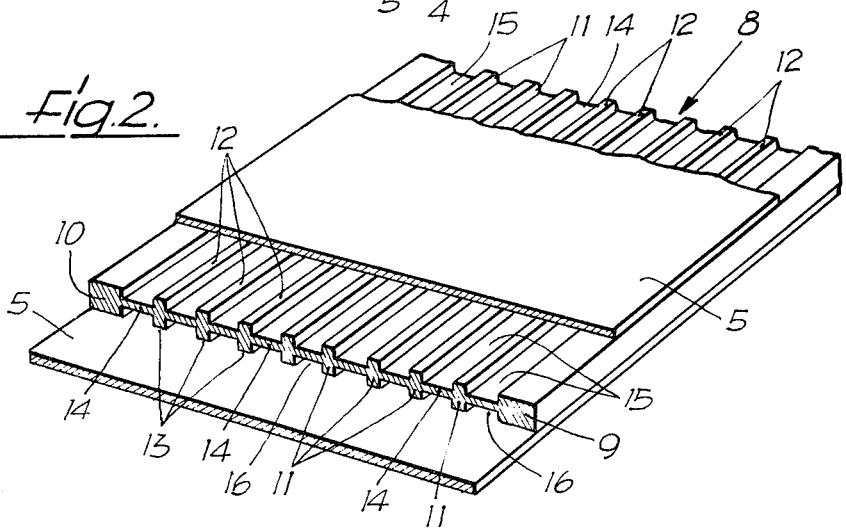

A preferred embodiment of the invention will be described in detail in conjunction with the accompanying drawings, in which:

FIG. 1 is a fragmentary perspective view of the core of a heat exchanger embodying two sets of passages (or conduit systems), it being understood that headers at the ends of core passages of the heat exchanger have been omitted for a better showing of core detail; and FIG. 2 is a perspective view, partly broken-away at different locations, to show the cross-section of one narrow fluid passage (or conduit system) foming part of the heat exchanger of FIG. 1.

FIG. 1 shows a heat exchanger having two outer-wall plates 1 and 2 in sandwiching relation to a first set of narrow cross-section fluid passages 3 for a vertical direction of flow, and a second set of narrow cross-section fluid passages 4 for a horizontal direction of flow. The two sets are interleaved within each other, that is to say, between each two fluid passages 4, there is one fluid passage 3. The fluid passages 3 are designed to accommodate flow of a first fluid and have a smaller cross-sectional area than the fluid passages 4 of the second set, and the latter are designed to accommodate a flow of coolant air as a second fluid. The outer wall plates 1 and 2 are solder-coated and define the outer elongate wall surface of each of the outermost fluid passages 4 of the second set. To form the remaining wall surfaces, that is to say those limiting not only the fluid passages 3 of the first set but also the fluid passages 4 of the second set, like solder-coated metal plates 5 are used, in spaced planes parallel to each other and to the planes of outer wall plates 1 and 2. Along their outer longitudinal edges, the fluid passages 4 are closed by rail-like spacers 6, positioned between plates 5 and preferably made of an aluminum-based material.

The fluid passages 4 of the second set are corrugated structures of conventional design, i.e., in the form of corrugated or undulating folded metal strips 7; the ends of the folds of strips 7 abut adjacent sheet-metal plates 5 and, in the case of the two outermost fluid passages 4, they abut the outer wall plates 1 and 2.

The corrugated structure in the vertical fluid passages 3 is of different design, as will now be made clear, with particular reference to FIG. 2. FIG. 2 shows a single-piece extruded section 8, preferably of aluminum-based material or light alloy, integrally formed in one piece with outer rail-like spacers 9 and 10 which define outer elongate wall surfaces of fluid passage 3. Each extruded section 8 has a number of straight ridges 11 which are equally spaced and positioned in a fluid passage 3 so as to be parallel to the longitudinal axis thereof. Ridges 11 are of generally rectangular cross-section and are of such size that their narrow sides serve as support faces 12 and 13 against which the two sheet-metal plates 5 of the involved fluid passage are abutted. Section webs 14 are integral with ridges 11 at a central region parallel to the adjacent plates 5. And as can be seen from FIG. 2, these webs 14, integrated with the middle regions of ridges 11, effectively form a plate at the middle of fluid passage 3 and parallel to the sheet-metal plates 5 which constitute the two sides of the fluid passage; this central plate divides the fluid passage into two parts 15 and 16 of equal size, and the thus-divided fluid passages is further subdivided by ridges 11. The outer rail-like spacers 9 and 10 take the form of ridges extending along the longitudinal edges of the plates, and are preferably broader than the other ridges 11, as shown.

The design of the corrugated structures within the fluid passages 3 to take the form of extruded sections will be seen to make the assembly essentially stronger than the corrugated sheet-metal structures of the prior art. On heating assembled parts of the heat exchanger in a solder bath or in a soldering oven, the sheet-metal plates 5 become solder-bonded (a) to the rail-like spacers 6 at the outer edges of fluid passages 4, (b) to the rail-like spacers 9 and 10 of fluid passages 3, and (c) to corrugated structures within the fluid passages 3 and 4. By employing such corrugated structures in the form of sections 8, and with the support faces 12 and 13 of each ridge 11 resting against the involved adjacent plates 5, these plates 5 are strongly secured to the solid ridges 11, thus providing a conduit system which precludes any chance of plates 5 being forced away from each other, even in the case of very high pressures within the fluid passage 3.

In place of the single-piece design of section 8 of the embodiment shown, it is possible to employ passage-dividing sections involving, for example, two pieces, each one of which is integrally formed in one piece with one of the outer rail-like spacers 9 and 10. It will further be clear that the rail-like spacers 9 and 10 may be made separately.

In place of the described corrugated metal structures of normal design within fluid passages 4 (i.e., having the form of corrugated metal strips 7), it is possible, for further increasing the strength of the assembly, to provide extruded sections within the fluid passage 4, and of desired size, but designed on the same lines as described for sections 8 within fluid passages 3. And it will be understood that such extruded sections in passages 4 may, if desired, be made in one piece with rail-like spacers 6.

What is claimed is:

1. A heat-exchanger sandwich construction for accommodating two fluids separately flowing in different directions, said construction comprising a plurality of like flat rectangular metal plates providing heat-exchange surfaces, and spacer means between adjacent plates and retaining said plates in spaced parallel relation; the spacer means between first and second successive plates of said plurality comprising a first pair of parallel rail members along a first pair of opposed parallel edges of said first and second plates, thereby establishing a first-passage flow direction through said construction; the spacer means between said second and the third successive plate of said plurality comprising a second pair of parallel rail members along the other opposed parallel edges of said second and third plates, thereby establishing a second-passage flow direction orthogonal to said first direction and through said construction; the spacer means between similarly successive plates comprising further of said first parallel rail members and further of said second parallel rail members in alternating succession, thereby establishing flows in said first and second directions in interlaced layers through said construction, so that each plate separates and serves the respective fluid flows in their orthogonally related directions; said spacer means including between parallel rail members of one of said pairs a longitudinally extruded metal plate that is characterized on both sides by spaced parallel grooves between longitudinal ridges, the longitudinal direction of the grooves and ridges being parallel to the involved rail members, and all rail members and ridges having bonded direct supporting contact with both of the adjacent plates which they space.

2. The heat-exchanger construction of claim 1, in which said longitudinally extruded metal plate integrally includes the rail members having bonded direct supporting contact with both of said adjacent plates.

3. A heat-exchanger sandwich construction for accommodating two fluids separately flowing in different directions, said construction comprising a plurality of like flat rectangular metal plates providing heat-exchange surfaces, and spacer means between adjacent plates and retaining said plates in spaced parallel relation; the spacer means between first and second successive plates of said plurality comprising a pair of parallel rail members along a first pair of opposed parallel edges of said first and second plates, thereby establishing a first-passage flow direction through said construction; the spacer means between said second and the third successive plates of said plurality comprising a longitudinally extruded metal plate that is characterized on both sides by spaced parallel grooves between longitudinal ridges, the longitudinal direction of the grooves and ridges being orthogonal to the first-passage flow direction, thereby establishing a second direction of flow orthogonal to said first direction and through said construction; the spacer means between similarly successive plates comprising further of said parallel rail members and further of said extruded metal plates in alternating succession, thereby establishing flows in said first and second directions in interlaced layers through said construction, so that each plate serves the respective fluid flows in their orthogonally related directions, and all rail members and ridges having bonded direct supporting contact with both of the adjacent plates which they space.

4. The heat-exchanger construction of claim 7 or claim 3, in which the spacer means between said first and second plates includes metal corrugations extending in the longitudinal direction of first-passage flow, said corrugations having bonded direct supporting contact with both of said first and second plates.

5. The heat-exchanger construction of claim 1 or claim 3, in which said metal plates are relatively thin, and in which the longitudinal ridges on one side of each said spacer means have flat outer surfaces in bonded direct supporting contact with a first adjacent thin metal plate, while the longitudinal ridges on the other side of each said spacer means have flat outer surfaces in bonded direct supporting contact with a second adjacent thin metal plate, whereby all metal plates are reinforced by such bonded supporting contacts and may therefore provide good heat conduction through thinner plate material than could otherwise withstand relatively high pressure of an involved fluid.

6. The heat-exchanger construction of claim 1 or claim 3, in which said metal plates are relatively thin, and in which the longitudinal ridges on one side of each said spacer means are of generally rectangular cross-section and have flat outer surfaces in bonded direct supporting contact with a first adjacent thin metal plate, while the longitudinal ridges on the other side of each said spacer means are of generally rectangular cross-section and have flat outer surfaces in bonded direct supporting contact with a second adjacent thin metal plate, whereby all metal plates are reinforced by such bonded supporting contacts and may therefore provide good heat conduction through thinner plate material than could otherwise withstand relatively high pressure of an involved fluid.

7. The heat-exchanger construction of claim 1 or claim 3, in which the spaced parallel ridges on one side of said extruded metal plate are in register with the spaced parallel ridges on the other side of said extruded metal plate, whereby each pair of registered ridges forms a solid rod and adjacent rods are integrally connected by strip-like web parts of said extruded metal plate, said rods having flat outer surfaces on each side of said spacer means, and said flat outer surfaces having direct supporting contact with the adjacent plates which they respectively space, whereby all metal plates are reinforced by such bonded supporting contacts and may therefore provide good heat conduction through thinner plate material than could otherwise withstand relatively high pressure of an involved fluid.

* * * * *